US006708697B1

(12) United States Patent
Ziff

(10) Patent No.: US 6,708,697 B1
(45) **Date of Patent: *Mar. 23, 2004**

(54) NAIL PROTECTOR

(76) Inventor: David Ziff, 1822 Hillcrest St., Orlando, FL (US) 32803

( * ) Notice: Subject to any disclaimer, the term of this patent is extended or adjusted under 35 U.S.C. 154(b) by 0 days.

This patent is subject to a terminal disclaimer.

(21) Appl. No.: 10/157,323

(22) Filed: May 29, 2002

(51) Int. Cl.[7] ..... A45D 29/28; A61G 11/00; A47F 3/00

(52) U.S. Cl. ..... 132/73; 312/1; 312/138.1

(58) Field of Search ..... 132/73, 73.5; 55/473, 55/DIG. 18; 454/56, 63; 96/142

(56) References Cited

U.S. PATENT DOCUMENTS

| | | | | | |
|---|---|---|---|---|---|
| 1,539,051 | A | | 5/1925 | McLean | |
| 2,561,125 | A | | 7/1951 | Leibowitz | 126/275 |
| 2,624,333 | A | | 1/1953 | Dixon | 128/1 |
| 2,651,982 | A | | 9/1953 | Weaver | 95/91 |
| 2,786,740 | A | | 3/1957 | Taylor | 23/259 |
| 2,962,156 | A | | 11/1960 | Adams | 206/45.14 |
| 3,084,684 | A | | 4/1963 | Saunders | 128/1 |
| 3,498,687 | A | | 3/1970 | Diccianni | 312/1 |
| 4,059,903 | A | * | 11/1977 | Piet et al. | 32/40 |
| 4,130,326 | A | | 12/1978 | Hornblad | 312/292 |
| 4,179,984 | A | * | 12/1979 | Gorcey | 98/115 |
| 4,697,854 | A | | 10/1987 | Lunsford | 312/223 |
| 4,730,880 | A | | 3/1988 | Schmidt | 312/209 |
| 4,834,357 | A | | 5/1989 | Bodenmiller | 269/289 |
| 5,011,013 | A | | 4/1991 | Meisner | 206/373 |
| 5,095,925 | A | | 3/1992 | Elledge | 134/61 |
| 5,112,373 | A | * | 5/1992 | Pham | 55/316 |
| 5,170,027 | A | | 12/1992 | Brodersen | |
| 5,316,733 | A | | 5/1994 | Rune | 422/104 |
| 5,336,128 | A | | 8/1994 | Birdsong | 454/56 |
| 5,380,077 | A | | 1/1995 | Puschner | 312/1 |
| 5,464,029 | A | * | 11/1995 | Renzt | 132/73.5 |
| 5,787,903 | A | * | 8/1998 | Blackshear | 132/73.5 |
| 5,928,075 | A | * | 7/1999 | Miya et al. | 454/56 |
| 6,058,523 | A | | 5/2000 | Sleboda | 4/619 |
| 6,241,328 | B1 | * | 6/2001 | Ziff | 312/1 |
| 6,302,947 | B1 | | 10/2001 | Rees, Jr. | 96/329 |
| 6,338,675 | B2 | | 1/2002 | Winkelman | 454/56 |

* cited by examiner

*Primary Examiner*—John J. Wilson
*Assistant Examiner*—Robyn Kieu Doan
(74) *Attorney, Agent, or Firm*—Brian S. Steinberger; Law Offices of Brian S. Steinberger, P.A.

(57) ABSTRACT

A self-enclosed workstation box having side access ports with built-in sleeve guards, a removable viewing shield, a storage bin inside of the box with a holder on the bin cover for storing and supporting supplies thereon. The viewing shield can be hinged to the box for allowing access to the entire interior of the box. Arm rests can be located inside for supporting any one of the hands of the operators and users of the box. A bottom port can allow for noxious fumes and debris to be removed from the box by a fan, and a filter the latter of which can prevent the fumes from passing into the atmosphere outside of the box.

20 Claims, 4 Drawing Sheets

1
10
12
15
20
25
27
60
65
67
68
70
75
76
77
78
79
80
85
90
92
95
96
55
50

NAIL PROTECTOR

This invention relates to manicure, and in particular to a see-through workstation enclosure that allows technicians to safely provide manicuring services without harm from noxious fumes and materials.

BACKGROUND AND PRIOR ART

Manicurists often require the use of various tools such as nail files and coatings such as nail polish remover, nail paint, and the like, that can produce dangerous substances. Noxious fumes, vapors, dust and debris have been known to circulate and can cause health problems to both the manicurist and their customer. For example, the dust and grindings that often are produced can be harmful if breathed by the manicurist and their customer.

Past solutions to solve these problems have included either or both facemasks and eye protection such as goggles, and even protective garments. However, these proposed solutions are difficult to use since they obstruct the manicurist and the customer, and are often inadequate for not totally controlling the environment.

Various workstations have been proposed over the years. See for example, U.S. Pat. No. 5,112,373 to Pham; U.S. Pat. No. 5,336,128 to Birdsong; U.S. Pat. No. 5,464,029 to Rentz; U.S. Pat. No. 5,787,903 to Blackshear; U.S. Pat. No. 6,302,947 to Rees, Jr.; and U.S. Pat. No. 6,338,675 to Winkelman. However, none of these patents totally removes all the problems addressed above.

Pham '373, Birdsong '128, Rees, Jr. '947, and Winkelman '675 each describe workstations that cannot adequately restrict debris and fumes from exiting about the sides of the hands of the manicurist and their customer, which can still contact the users. Furthermore, most of these devices have no bottom floor. Thus, table top surfaces can be damaged by fumes and debris resulting from using these workstations.

Rentz '029 and Blackshear '903 each describe other elaborate large and expensive workstations that require types of "curtains" that the users must insert their hands through. The "curtains" remain stationary and cannot move with the users' hands and would be inherently uncomfortable as well as would not provide adequate seals about the users' hands. Thus, fumes and debris can still exit these workstations. Furthermore, these large cumbersome devices must be mounted directly on the floor and take up a substantial amount of time. Thus, these devices cannot be considered to be portable nor mountable on tabletops, and the like.

There are other additional problems with these known prior art devices. For example, none of the above manicure type stations allow for internal storage of manicure supplies within the stations. Furthermore, none of these stations allow for easy access into the station without having to go through the hand portal openings. Thus, the inside of the station itself cannot be easily accessible. Still furthermore, none of the proposed devices allows for supporting the hands of either or both the manicurist and their customer. Requiring the users to continuously hold their hands up can cause both discomfort and physical pain to the users of these stations. Thus, the need exists for solutions to the above cited problems with the prior art.

SUMMARY OF THE INVENTION

The first objective of this invention is to provide a self-enclosed manicure work station that eliminates the need for a users to wear protective eyewear, facemasks, gloves, and protective garments while safely and securingly sealing the hands of the users inside of the workstations.

The second object of the present invention is to provide a self-enclosed manicure work station that does not need to be floor mounted and can be both portable and used on tabletop.

The third object of the present invention is to provide a self-enclosed manicure work station that allows a manicurist to manicure nails in a simple, non complex environment.

The fourth object of the present invention is to provide a self-enclosed manicure work station that confines all resultant dust, and waste within the enclosure and allows for easy removal of the resultant dust and waste through suction and/or replaceable/cleanable filters, and the like.

The fifth object of the present invention is to provide a self-enclosed manicure workstation having an internal support rack/stand/compartment that allows supplies to be safely held, stored inside of the workstation which allows supplies to be easily and continuously accessible while the manicurist is working.

The sixth object of the invention is a means of controlling odors.

The seventh object of this invention is to provide a self-enclosed manicure workstation having a large openable door for allowing the inside of the workstation to be easily serviced and cleaned.

The eigth object of this invention is to provide a self-enclosed manicure workstation that uses a removable magnifying viewing window to magnify the work being performed and an internal light source.

The ninth object of this invention is to provide a self-enclosed manicure workstation that can use an armrest support for either or both users of the workstation.

A preferred embodiment of the self-enclosed manicure type workstation can include a box having a closed top, sides, and bottom having side access ports in the sides, sleeve guards in the access ports for sealingly wrapping about a wrist of a user, and a removable viewing shield cover on the top of the box for allowing access for servicing an cleaning within the workstation.

The box can include four openings, two one opposite sides of the box. One set of openings can be for allowing the hands of an operator such as manicurist to be inserted inside, and the second pair of openings can be for allowing the hands of a user such as a manicurist customer to be inserted inside. The sleeve guards can include narrow elastic wrist type portions for wrapping about wrists of the manicurist and customer.

The viewing shield can also include a hinged edge for allowing shield to pivot to an open position allowing greater access to the interior of the workstation and optionally, a magnifying lens portion.

The workstation can also include a drawer accessible outside of the workstation for both supporting supplies inside of the workstation and being removable from a side port of the workstation.

Fan exhausts with removable filters can safely remove noxious fumes and debris from the workstation while not passing the fumes and debris into the surrounding atmosphere.

Upright armrest supports can be inside of the box for supporting the hand(s) of any users of the workstation to remove physical discomfort and allow for one's hands to be consistently supported in fixed positions.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

The subject invention is related to the inventors' previous U.S. Pat. No. 6,241,328 to Ziff for an "enclosed workstation", which is incorporated by reference.

Figure 1:
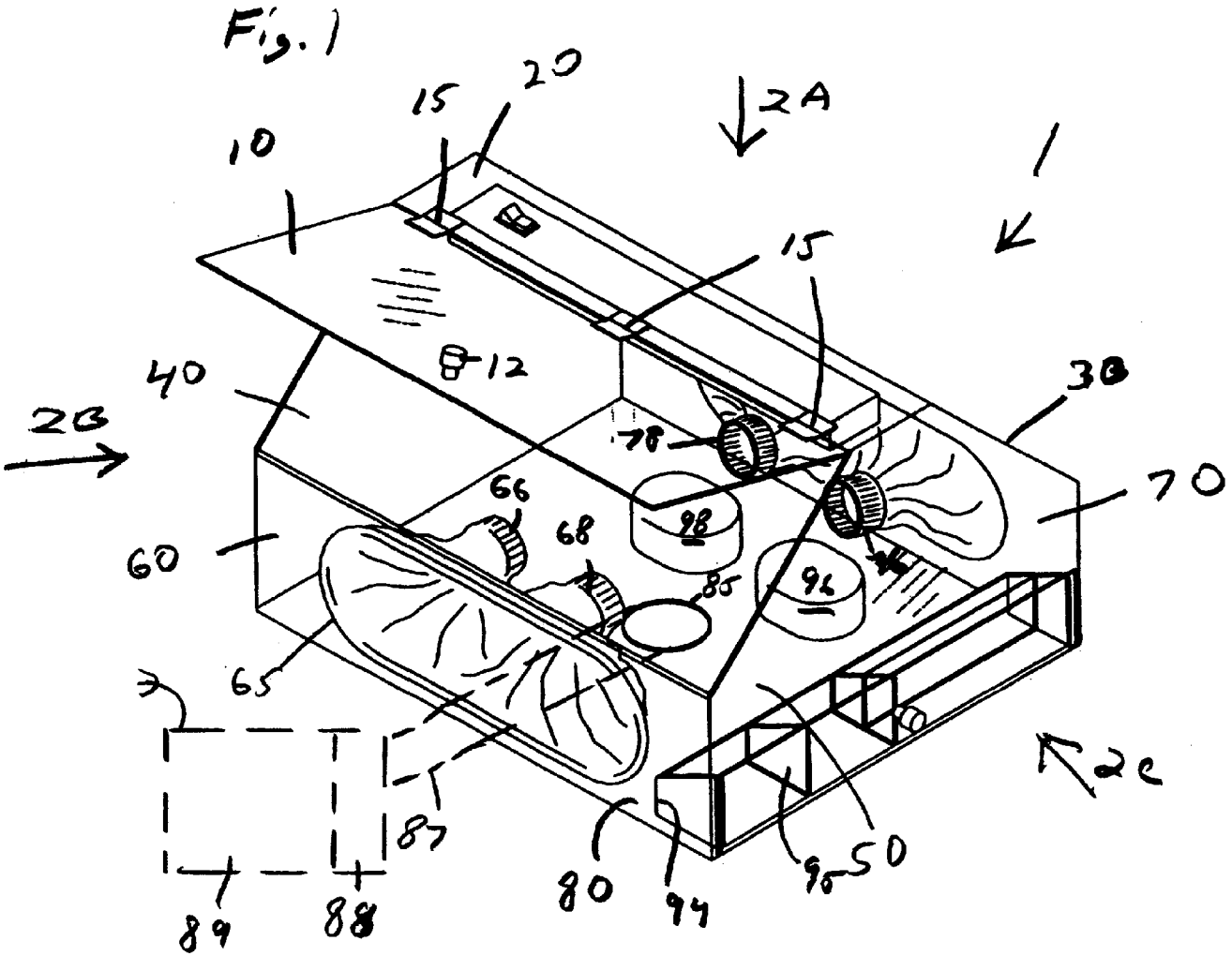
FIG. 1 shows a perspective view of the manicure workstation invention with viewing door in an open position
Figures 2A, 2B, 2C:
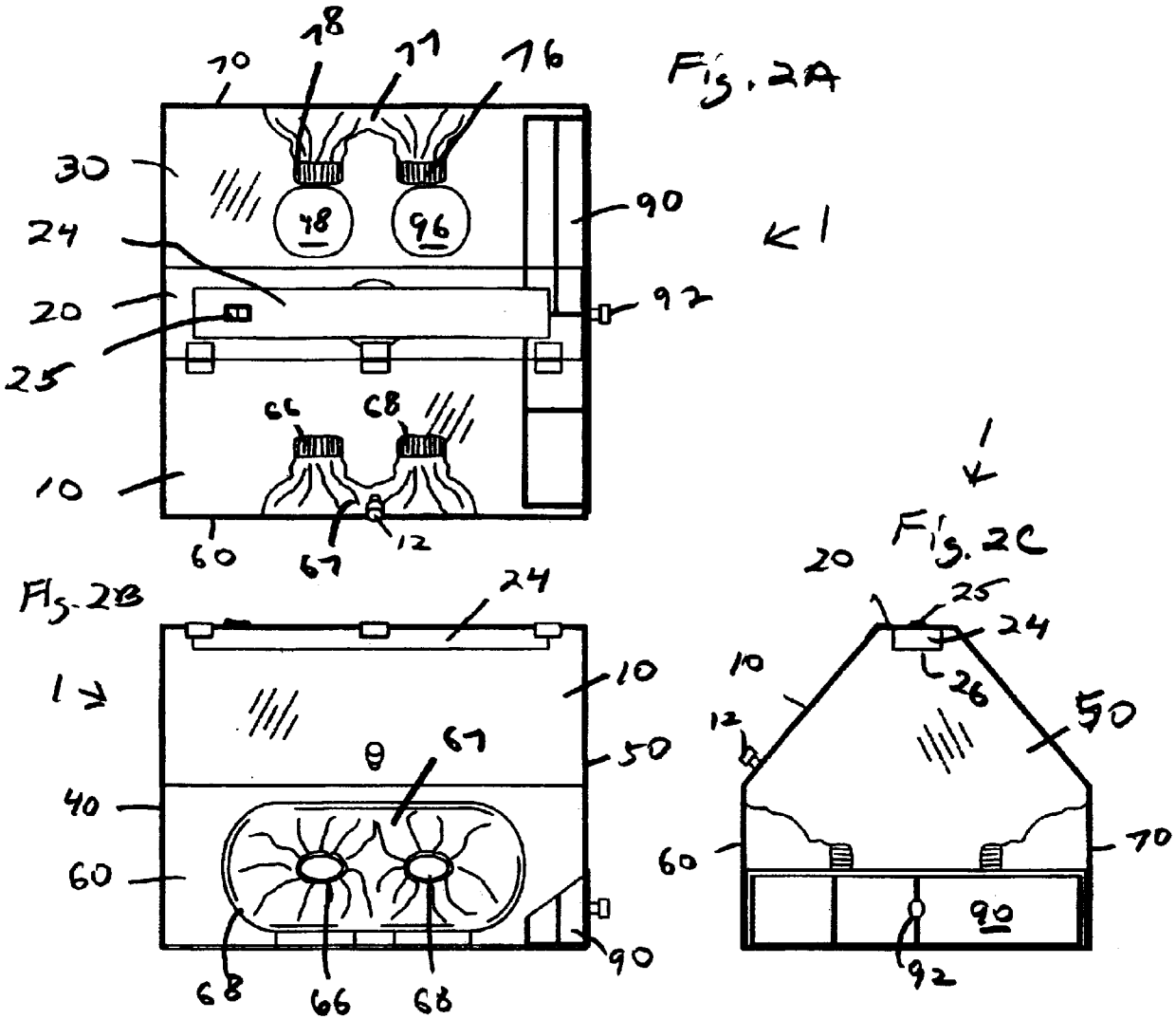
FIG. 2A is a top view of the manicure workstation of FIG. 1 along arrow 2A.
FIG. 2B is a front view of the manicure workstation of FIG. 1 along arrow 2B.
FIG. 2C is drawer side view of the manicure workstation of FIG. 1 along arrow 2C.
Figure 3:
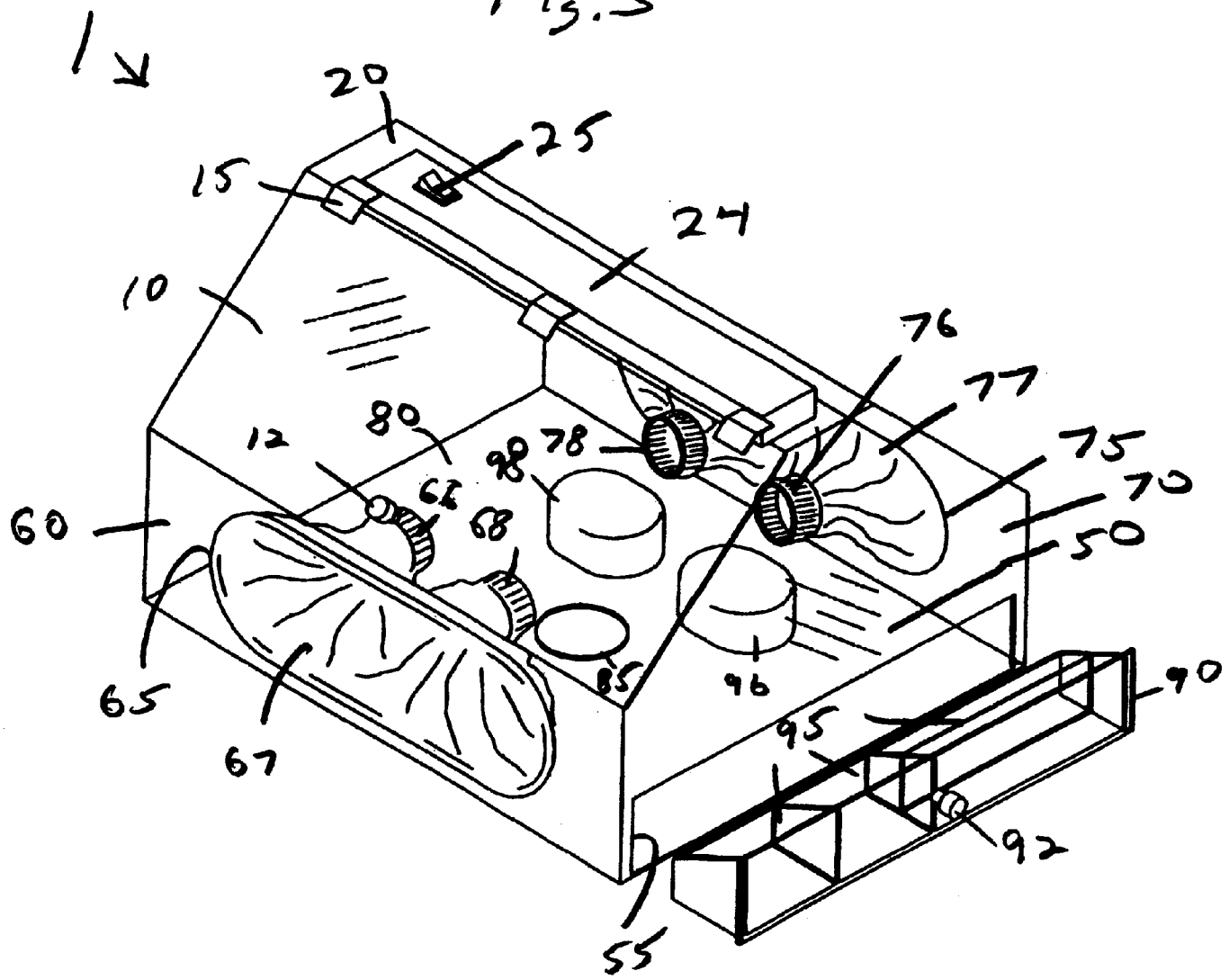
FIG. 3 is another perspective view of the manicure workstation of FIG. 1 with side drawer open.

FIG. 1 shows a perspective view of the manicure workstation invention 1 with viewing door 10 in an open position. FIG. 2A is a top view of the manicure workstation 1 of FIG. 1 along arrow 2A. FIG. 2B is a front view of the manicure workstation 1 of FIG. 1 along arrow 2B. FIG. 2C is drawer side view of the manicure workstation 1 of FIG. 1 along arrow 2C. FIG. 3 is another perspective view of the manicure workstation 1 of FIG. 1 with side drawer 90 open.

Referring to FIGS. 1, 2A, 2B, 2C and 3, workstation 1 can include an angled viewing shield door 10 and flat top panel 20, and second angled top panel 30 that all together can form a lid portion of the workstation 1. Door 10 and top panel 30 can each be angled at approximately 45 degrees. The panels 10, 20, 30 can fit above vertical side wall panels 40 and 50, which are also attached to front wall 60 and rear wall 70. The bottom of workstation 1 can include a floor panel 80. All the panels can be prefitted together, and each can be formed from see-through material such as but not limited to Plexiglas, acrylic, plastic, glass, safety glass, and the like.

The angled viewing door 10 can include a knob 12 for allowing the door to be opened upward so that the door 10 pivots about hinges 15 which are also attached to flat top panel 20. The large door 10 allows the interior of the workstation to be easily reached for servicing and cleaning, and the like. See through door panel can also include a magnifying lens portion to allow the inside of the workstation to be magnified. Positioned on flat top panel 20 can be a light housing 24 having a downwardly directed light source 26 such as but not limited to a fluorescent bulb, LED (light emitting diode), and the like, that can be selectively activated by a switch 25 such as but not limited to a toggle switch, depressible button type switch, and the like. Light source 26, can be selectively used to provide extra illumination into the workstation 1 above the hands of the manicurist and their customer.

Along the front vertical wall 60 can be a longitudinal opening 65 such as an oval type opening, and the like. A flexible material 67 such as but not limited to pliable plastic sheathing, burlap, elastomer, and the like, and combinations thereof, can be attached to the opening 65 and can extend inward into the inside of workstation 1 to form dual sleeve type guards 67 that each end at narrow elastic wrist type portions 66, 68, respectively. The sleeve guards 67 can be formed from materials that prevent noxious fumes and debris such as dust from exiting out of the workstation 1. An operator of the workstation 1, such as a manicurist can use the sleeve guards 67 for inserting their hands therethrough, and use the viewing door 10 to see inside the workstation 1.

Along the rear vertical wall 70 can be a longitudinal opening 75 such as an oval type opening, and the like. A flexible material 77 such as but not limited to pliable plastic sheathing, burlap, elastomer, and the like, and combinations thereof, can be attached to the opening 75 and can extend inward into the inside of workstation 1 to form dual sleeve type guards 77 that each end at narrow elastic wrist type portions 76, 78, respectively. The sleeve guards 77 can be formed from materials that prevent noxious fumes and debris such as dust from exiting out of the workstation 1. A user of the workstation 1, such as a customer of the manicurist can use the sleeve guards 77 for inserting their hands therethrough, and use the angled top panel 30 to see inside the workstation 1.

Along a bottom portion of the vertical side wall 50 can be a slot opening 55 that allows a supply drawer 90 that can function as a supply bin, to be pulled out and pushed in by a knob 92. The drawer 90 can include partitions 95 that can form separate types of racks for allowing various supplies to be stored inside and easily accessible inside of the workstation, and easily removed and replenished by pulling the drawer 90 out of the workstation 1. The partitions 95 of the drawer can have a lower height portion 94 extending inward so that supplies can be more easily retrieved by hands inside of the workstation 1.

On the floor panel 80 of the workstation 1 can be one, two or more upwardly extending supports 96, 98 that can function as arm rests and the like. The arm rests can include soft upper surfaces such as pillow material and the like, that can conform to portions of one's arms, wrists, and the like, and is intended to alleviate any physical discomfort that would occur with having to constantly keep one's hands in a raised position. Additionally, the arm rests 96, 98 allow the user/customer to keep their hands in a fixed positions so that the manicure can more easily and efficiently be completed. Although the arm rests 96, 98 are positioned in front of the sleeve guards 77 of the customer/user, the arm rests can also be positioned adjacent to the sleeve guards 67 of the operator/manicurist.

Additionally, there can be a portal type opening 85 in the floor 80 that can be connected to an exhaust line 87 so that an exhaust fan 89 can pull noxious fumes, and debris out of the workstation 1 when needed. A replaceable filter 88, such as a carbon filter, charcoal filter, and the like, can also be used.

Figure 4:
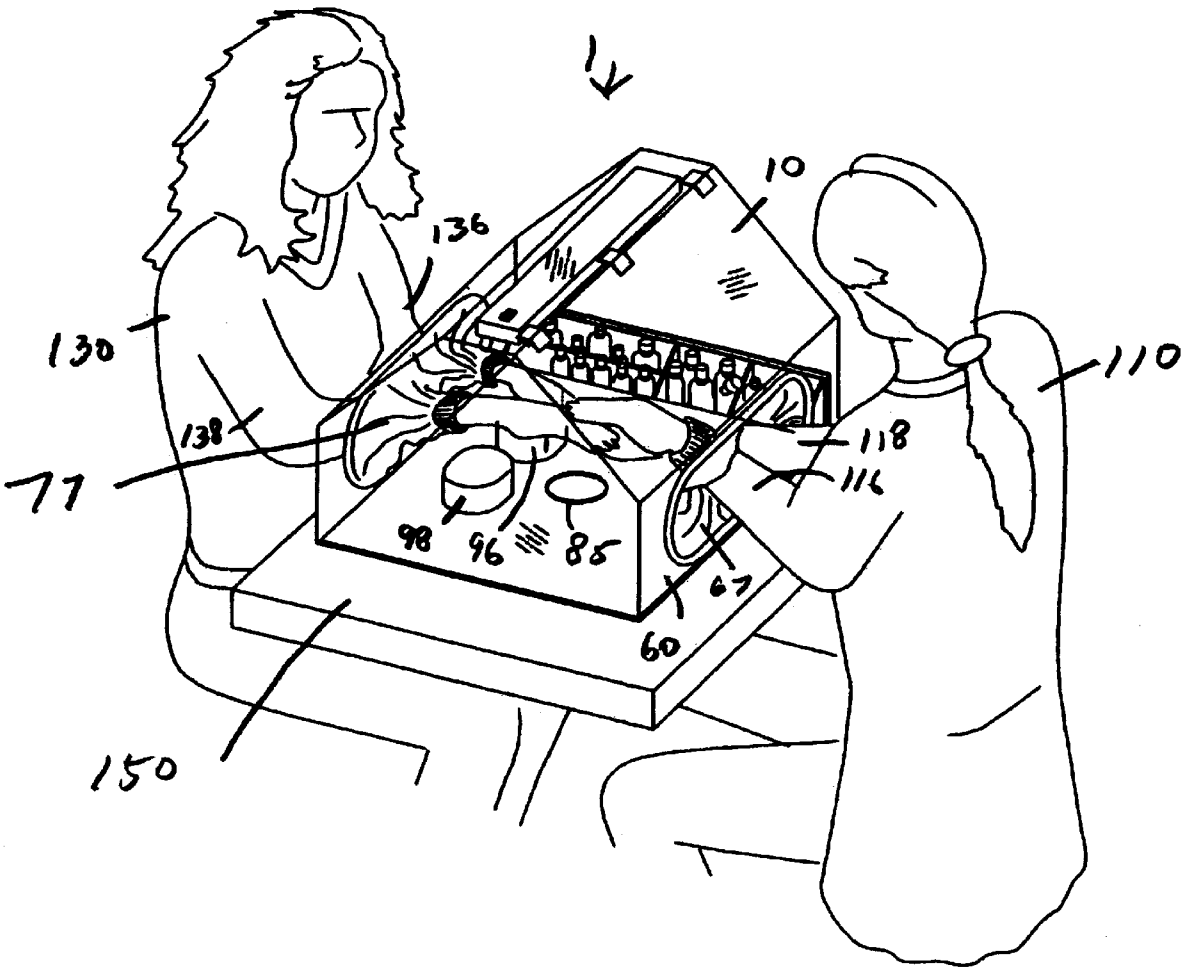
FIG. 4 shows the manicure workstation of the above figures used by a manicurist and customer.

FIG. 4 shows the manicure workstation 1 of the above figures used by an operator 110 such as a manicurist and a user 130 such as their customer. In operation, left and right hands 116, 118 of the manicurist can be inserted into the dual sleeve guards 67 so that the elastic wrist guards 66, 68 sealingly fit about the respective wrist portions of the manicurist 110. A customer 130 can likewise insert their left and right hands 136, 138 into the dual sleeve guards 77 so that elastic wrist guards 76, 78 sealingly fit about the respective wrist portions of the customer. Arm rests 96, 98 can help support the respective wrists of the customer 130 so that the manicurist 110 does not have to physically hold and raise up the customers hands nor has to consistently hold the customers hands in a fixed position during the manicure.

Although, the preferred embodiment shows a single sleeve guard material 67, 77 for the operator side and the user side of the workstation 1, the invention can use separate sleeve guards for the respective right and left hands of the operator and the user.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A portable self-enclosed manicurist workstation, comprising:

a portable box with top, a front wall, left and right sides, a rear wall and bottom;

a first access port portion on the front wall of the box;

a second access port portion on the rear wall of the box, the second access port position being directly opposite to the first access port portion;

a first pair of elongated sealable sleeve guards attached to the first access port portion for allowing right and left arms and hands of manicurist to be inserted therethrough;

a second pair of elongated sealable sleeve guards attached to the second access port portion for allowing right and left arms and hands of a customer to be inserted therethrough; and a viewing shield cover on the top of the box for allowing both the manicurist and the customer to view inside of the box, wherein the portable box is easily moveable from place to place and is able to placed on different table top surfaces.

2. The self-enclosed manicurist workstation of claim 1, wherein the viewing shield includes:

a hinged edge for allowing shield to pivot to an open position allowing greater access within the workstation so that insides of the workstation can be serviced and cleaned.

3. The self-enclosed manicure workstation of claim 1, further comprising:

a holder inside the workstation for supporting and holding supplies for the manicurist.

4. The self-enclosed manicure workstation of claim 3, wherein the holder includes:

a rack for allowing the supplies to be easily accessible.

5. The self-enclosed manicure workstation of claim 3, wherein the holder includes:

a drawer portion that allows the holder to drawn out of the side of the workstation.

6. The self-enclosed manicure workstation of claim 1, wherein the viewing shield includes:

a magnifying lens portion.

7. The self-enclosed manicure workstation of claim 1, further comprising:

a light for illuminating inside of the workstation.

8. The self-enclosed manicure workstation of claim 1, further comprising:

an upright support rest inside of the workstation with a conformable portion for supporting a portion of at least one of an arm and a hand of a user inside of the workstation for supporting the at least one of the arm and the hand in a fixed position by being placed in the conformable portion of the support rest.

9. The self-enclosed manicure workstation of claim 1, further comprising:

means for removing fumes and debris from the workstation; and a filter for restricting the size of the fumes and the debris being removed.

10. The self-enclosed manicure workstation of claim 8, wherein the upright support rest includes:

a left support rest with left upper conformable portion for supporting at least one of the left hand and left forearm of the user in a left fixed position by the left upper conformable portion; and a separate right support rest with right upper conformable portion for supporting at least one of right hand the right forearm of the user in a right fixed position by the right upper conformable portion, the right support rest spaced apart from and next to the left support rest.

11. The self-enclosed manicure workstation of claim 1, further comprising:

a single first flexible material cover for covering the first access port portion, wherein the first pair of elongated sealable sleeve guards extend into the box from the single first flexible material; and a single second flexible material cover for covering the second access port portion, wherein the second pair of elongated sealable sleeve guards extend into the box from the single second flexible material.

12. The self-enclosed manicure workstation of claim 1, wherein each of the top, the front wall, the left and the right sides and the rear wall include see-through materials to allow both the manicurist and the customer to view inside of the box.

13. A portable self-enclosed manicure workstation, comprising:

a portable box having a closed top, a front wall, a rear wall, left and right sides, and bottom, wherein the closed top, the left and the right sides each being formed from see-through materials for allowing viewing inside of the box; first access ports in the front wall;

second access ports in the rear wall;

a first pair of elongated sleeve guards in the first access ports with elastic wrist ends for sealingly wrapping about a left wrist and a right wrist of a manicurist;

a second pair of elongated sleeve guards in the second access ports with elastic wrist ends for sealingly wrapping about a left wrist and a right wrist of a customer; and a removable see-through viewing shield cover on the top of the box for allowing access for servicing an cleaning within the workstation, wherein the portable box is easily moveable from place to place and is able to placed on different table top surfaces.

14. The self-enclosed manicure workstation of claim 13, wherein the viewing shield further includes:

a hinged edge for allowing shield to pivot to an open position allowing greater access to the interior of the workstation.

15. The self-enclosed manicure workstation of claim 13, wherein the viewing shield includes:

a magnifying lens portion.

16. The self-enclosed manicure workstation of claim 13, further including:

a drawer for both supporting supplies inside of the workstation and being removable from a side port of the workstation.

17. The self-enclosed manicure workstation of claim 13, further comprising:

means for removing fumes and debris from the workstation; and a filter for restricting the size of the fumes and the debris being removed.

18. The self-enclosed manicure workstation of claim 13, further comprising:

an upright support rest inside of the workstation with a conformable portion for supporting a portion of at least one of an arm and a hand of a user inside of the workstation for supporting the at least one of the arm and the hand in a fixed position by being placed in the conformable portion of the support rest.

19. The self-enclosed manicure workstation of claim 18, wherein the upright support rest includes:

a left support rest with left upper conformable portion for supporting at least one of the left hand and left forearm of the user in a left fixed position by the left upper conformable portion; and a separate right support rest with right upper conformable portion for supporting at least one of right hand the right forearm of the user in a right fixed position by the right upper conformable portion, the right support rest spaced apart from and next to the left support rest.

20. The self-enclosed manicure workstation of claim 19, further comprising:

a single first flexible material cover for covering the first access ports, wherein the first pair of elongated sleeve guards extend into the box from the single first flexible material; and a single second flexible material cover for covering the second access port portion, wherein the second pair of elongated sleeve guards extend into the box from the single second flexible material.

* * * * *